US005497979A

United States Patent [19]

Schulz, Jr. et al.

[11] Patent Number: 5,497,979

[45] Date of Patent: Mar. 12, 1996

[54] FOUNDATION UNIT, WIRE ELEMENT FOR THE FOUNDATION UNIT, AND METHOD OF FORMING THE FOUNDATION UNIT

[75] Inventors: Martin Schulz, Jr.; Billie Pieper; David Warner, all of Brenham, Tex.

[73] Assignee: Steadley Company, Carthage, Mo.

[21] Appl. No.: 405,914

[22] Filed: Mar. 15, 1995

Related U.S. Application Data

[63] Continuation of Ser. No. 123,324, Sep. 17, 1993, abandoned.

[51] Int. Cl.[6] ..... F16F 3/00

[52] U.S. Cl. ..... 267/103; 5/247

[58] Field of Search ..... 5/247, 255; 267/80, 267/95, 103, 105–107

[56] References Cited

U.S. PATENT DOCUMENTS

| | | | |
|---|---|---|---|
| 4,339,834 | 7/1982 | Mizelle | 267/103 X |
| 4,760,616 | 8/1988 | Hiatt et al. | 267/103 X |
| 4,770,397 | 9/1988 | Schulz, Jr. | 267/103 X |
| 4,921,228 | 5/1990 | Lowe | 267/106 X |
| 5,165,667 | 11/1992 | Dabney | 267/103 |
| 5,188,344 | 2/1993 | Dabney | 267/103 |
| 5,231,712 | 8/1993 | Edwards et al. | 2/255 |
| 5,346,190 | 9/1994 | Dabney | 267/103 X |

*Primary Examiner*—Robert J. Oberleitner
*Assistant Examiner*—Peter M. Poon
*Attorney, Agent, or Firm*—Lee, Mann, Smith, McWilliams, Sweeney & Ohlson

[57] ABSTRACT

A wire support member for a foundation unit, the resulting foundation unit, and a method of fabricating the foundation unit. The wire support member comprises a pair of parallel wire elements arranged in mirror image with a transverse link extending between and joining the wire elements. A dimple is formed in the top of each of the wire elements to form an engagement location to accommodate and seat a grid wire extending transverse to the wire support member. The foundation unit is comprised of a series of the wire support members installed in a flat grid wire top bearing structure and affixed to a rigid bottom substructure. The foundation unit is formed by inserting a wire support member at an oblique angle to the grid wire top bearing structure with the wire elements straddling a pair of longitudinal grid wires and with one wire element being located on one side of a transverse grid wire and with the other wire element being located on the other side of the transverse grid wire. The support member is then inserted and pivoted until its top is generally coextensive with the flat grid, and it is then rotated until the transverse grid wire is seated in the dimples.

11 Claims, 2 Drawing Sheets

FOUNDATION UNIT, WIRE ELEMENT FOR THE FOUNDATION UNIT, AND METHOD OF FORMING THE FOUNDATION UNIT

This application is a continuation of application Ser. No. 123,324, filed Sep. 17, 1993, now abandoned.

BACKGROUND OF THE INVENTION

This invention relates to foundation units, and more particularly to a wire support member for a foundation unit, the resulting foundation unit including the wire support member, and a unique method of fabricating the foundation unit from the support member.

Foundation units of the type of the present invention are typically composed of coil springs mounted on a wooden frame. The coil springs are reinforced and held in place by a grid wire top bearing structure. Coils are secured to the grid wire top bearing structure by a series of clips, pigtails or the like, or, as described in U.S. Pat. No. 3,953,903, the coil springs may be snapped into a specially formed grid wire top bearing structure. However, foundation units employing conventional coil springs, although being quite satisfactory for many applications, tend not to provide desired support under all load conditions. Also, fabrication of such a foundation unit can be time-consuming and expensive, and shipping of parts or of the assembled foundation unit can also be quite expensive. Therefore, other types of wire elements, such as those illustrated in U.S. Pat. Nos. 4,377,279; 4,770,397 and 5,005,809 have been developed, the elements having a full range of characteristics from no spring whatsoever to coil spring-like characteristics, and also providing for more economical construction and/or shipment of a foundation unit, either assembled or in a knocked-down manner for assembly at a remote location.

SUMMARY OF THE INVENTION

The invention provides wire support members for a foundation unit of the type having a grid wire top bearing structure and a rigid bottom substructure. The wire support members each comprise a pair of wire elements arranged in mirror image to one another, the wire elements being located in spaced, parallel planes. Each wire element includes a sinuous central segment comprising a series of generally C-shaped portions lying in a plane, with adjacent curved portions being oppositely facing. Each wire element also includes an upper attachment segment and a lower attachment segment, with the sinuous central segment extending between the upper and lower attachment segments. Means is provided, extending between and joining the upper attachment segments, to form the wire support member as a continuous element. A grid wire engagement location is formed in each upper attachment segment, the engagement location comprising a dimple in the upper attachment segment shaped to accommodate and seat a grid wire extending generally perpendicular to the upper attachment segment.

In accordance with the preferred form of the invention, each sinuous central segment comprises three of the C-shaped curved portions in series. The lower attachment segments are unattached to one another, and each lower attachment segment includes a tip raised toward the central segment.

The interconnection of the wire elements preferably comprises a transverse link. In accordance with the preferred form of the invention, the link comprises an S-shaped curved portion.

A foundation unit fabricated in accordance with the invention includes a series of parallel rows and columns of the wire support members of the invention, installed between a flat top bearing structure and a rigid bottom substructure. The flat top bearing structure is composed of spaced parallel longitudinal grid wires and spaced parallel transverse grid wires intersecting the longitudinal grid wires, with the grid wires being affixed to one another where intersecting. At least the longitudinal grid wires include a grid wire pair having the wires separated a predetermined interval. Each of the support members is installed over a grid wire pair, with the wire elements of the support member being separated at least the predetermined interval which the grid wires are separated.

A foundation unit is formed by first fabricating the grid wire top bearing structure, a series of the wire support members, and the rigid bottom substructure. To install the wire support members, they are inserted at an oblique angle to the top bearing structure with downwardly depending legs (the wire elements) of the spaced wire elements straddling a grid wire pair, and with one leg being located on one side of a transverse grid wire and the other leg being located on the other side of the transverse grid wire. The wire support member is then further inserted until its top is generally coextensive with the grid wire top bearing structure. When that occurs, the wire support member is then rotated until attachment segments of its wire legs are located beneath the transverse grid wire straddled by the legs, while the S-shaped connecting link between the wire elements is located above the transverse grid wire. After the wire support members are installed in the grid wire top bearing structure, they are stapled or otherwise conventionally affixed to the bottom substructure, and the resulting foundation unit is completed by applying padding and a covering in a conventional fashion.

As explained above, each of the upper attachment segments includes a dimple shaped to accommodate and seat the transverse grid wire. Therefore, during the step of rotation of the wire support member, it is rotated sufficiently so that the transverse grid wire is seated in the dimples of the upper attachment segments. Once rotation has been completed and the wire support member is in place, the lower attachment segments of the legs can then be affixed to the bottom substructure by stapling or otherwise affixing them in a conventional fashion.

BRIEF DESCRIPTION OF THE DRAWINGS

The invention is described in greater detail in the following description of an example embodying the best mode of the invention, taken in conjunction with the drawing figures, in which.

DESCRIPTION OF AN EXAMPLE EMBODYING THE BEST MODE OF THE INVENTION

Figure 1:
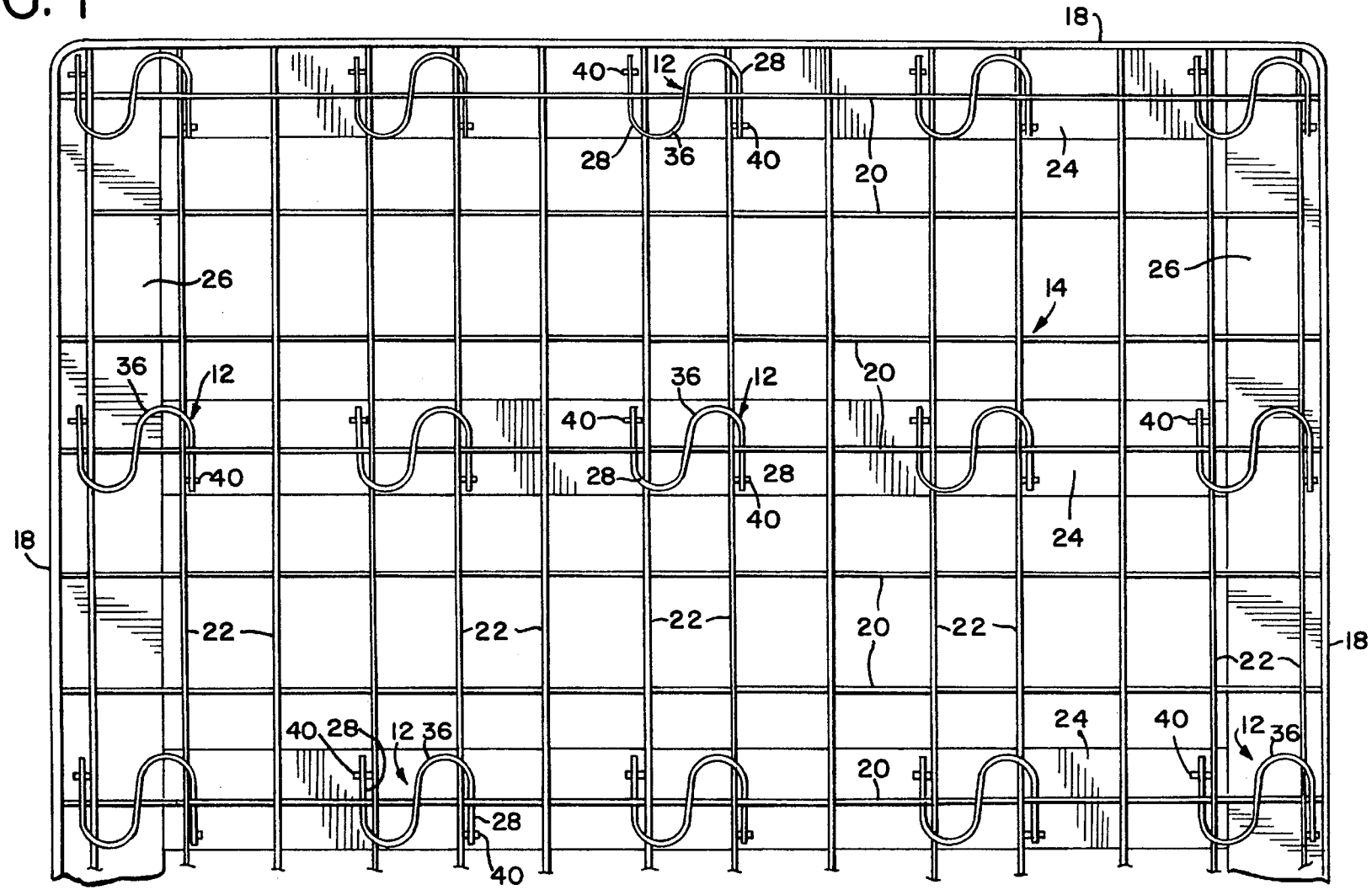
FIG. 1 is a top plan view of one end of a foundation unit according to the invention employing a series of parallel rows and columns of the wire support members according to the invention.

A foundation unit according to the invention is shown generally at 10 in the drawing figures. The foundation unit 10 employs a series of wire support members 12 according to the invention arranged generally in parallel rows and columns, with the support members 12 being installed between a conventional grid wire top bearing structure 14 and a rigid bottom substructure 16. With the exception of the unique wire support members 12 and their particular installation in the foundation unit 10, the foundation unit 10 can otherwise be conventional, and therefore only one end thereof has been shown in the drawing figures. The dimensions of the foundation unit 10 will depend on the resulting desired size of the foundation unit.

The grid wire top bearing structure 14 is composed of a perimeter border member 18 and a series of parallel transverse rows 20 and longitudinal columns 22 of grid wires extending between opposite edges of the perimeter member 18. The grid wires 20 and 22 may be welded to one another at cross points, as is conventional, and may be welded to or wrapped about the perimeter border member 18. The means by which the grid wires 20 and 22 and perimeter border member 18 are affixed to one another forms no part of the invention.

The rigid bottom substructure 16 is composed of a series of cross slats 24 extending between longitudinal side slats 26. As is conventional, end slats may be used at opposite ends of the foundation unit 10 in place of a cross slat 24, and the slats may be formed of wood and be glued, stapled, nailed or otherwise affixed to one another as desired.

Each wire support member 12 is composed of a pair of spaced, parallel wire elements, each wire element being composed of an upper attachment segment 28, a lower attachment segment 30, and a sinuous central segment composed of a series of C-shaped curved portions 32. The upper attachment segment 28, lower attachment segment 30 and curved portions 32 of each wire element all lie in a plane. The planes in which the wire elements lie are parallel and are spaced from one another, and the wire elements are arranged in mirror image to one another for compressive balancing of the wire support member 12 when the foundation unit 10 is used. As shown, three of the C-shaped curved portions 32 as a sinuous central segment preferably form a downwardly-depending leg on each side of the wire support member 12. It is preferred that at least two of the curved portions 32 be employed for proper compressibility, with three being found to be most preferable.

Figure 2:
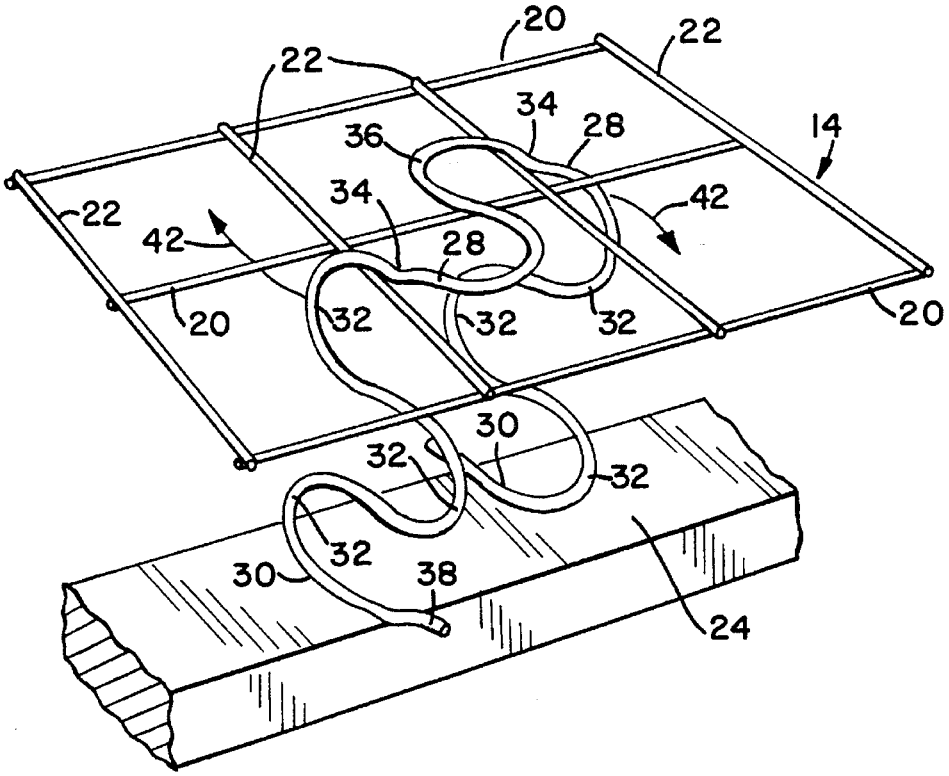
FIG. 2 is an enlarged perspective view of a cut away portion of the foundation unit according to the invention, showing a progressive step of installation of a wire support member in the grid wire top bearing structure.
Figure 3:
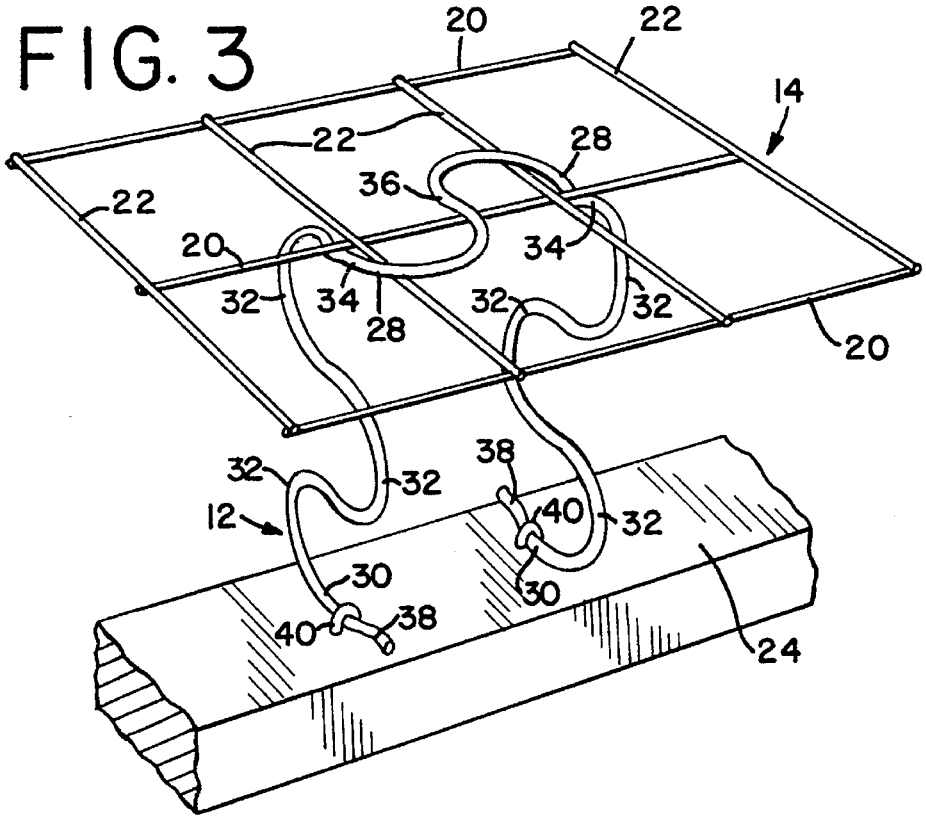
FIG. 3 is a view similar to FIG. 2, but showing the wire support member fully installed in the grid wire top bearing structure and stapled to the rigid bottom substructure.

A dimple 34 is formed in each of the upper attachment segments 28, as shown in FIGS. 2 and 3. The dimples 34 are formed to engage a transverse grid wire 20 and seat the grid wire as it extends generally perpendicular to the upper attachment segments 28. The upper attachment segments 28 are joined by an integral link comprising an S-shaped curved portion 36. As illustrated, the S-shaped curved portion extends from opposite ends of the respective upper attachment segments 28.

Preferably, the wire support members 12 are unitary, formed from a length of wire of a generally circular cross section which has been bent into the shape illustrated in the drawing figures. Each lower attachment segment 30 includes a concluding tip 38 which is raised toward the upper portions of the support member 12. The tips 38 enhance the securing of the wire support members 12 to the rigid bottom substructure 16 such as, as shown in FIG. 3, by means of staples 40 across the lower attachment segments 30.

As illustrated, when each of the wire support members 12 is in place, it straddles a pair of the longitudinal grid wires 22. Thus, the spacing of the upper attachment segments 28 must be at least that of the grid wire pair 22 which is straddled, and preferably a bit more to facilitate assembly of the foundation unit 10. The upper attachment segments 28 and transverse S-shaped curved portion 36 lie generally in a plane, and when the foundation unit 10 is assembled, each wire support member 12 has the opposite upper attachment segments 28 seated beneath one of the transverse grid wires 20, with the grid wire 20 engaged in the respective dimples 34. The S-shaped curved portion 36 extends over the opposite longitudinal grid wires 22 straddled by the wire support member 12, and also over the transverse grid wire 20 seated in the dimples 34. Therefore, the wire support member 12 is locked rigidly in place, and when stapled to a cross slat 24 or longitudinal side 26, completes the formation of a foundation unit of exceptional strength and integrity. Although not illustrated, if desired in order to guarantee integrity of the foundation unit 10, a small minority of the wire support members 12 can be further attached to the grid wire top bearing structure 14 by conventional clips or other means. Four clips, each applied in each of the four corners of the foundation unit 10 to the wire support members 12 located in those locations, are more than adequate to provide this final guarantee.

The foundation unit 10 is assembled in a conventional fashion after fabrication of the grid wire top bearing structure 14 and the rigid bottom substructure 16. The wire support members 12 are installed periodically in parallel rows and columns, each wire support member 12 being installed by first inserting the wire support member 12 with its top at an oblique angle to the grid wire top bearing structure 14, and with its depending legs straddling a pair of the longitudinal grid wires 22 and with one leg being located on one side of one of the transverse grid wires 20 and the other leg being located on the other side of the transverse grid wire 20. The wire support member 12 is then further inserted and its top is pivoted until its top is generally coextensive with the grid wire top bearing structure 14, as illustrated in FIG. 2. The wire support member 12 is then rotated in the direction shown by the arrows 42 in FIG. 2, until the opposite upper attachment segments 28 are located beneath the transverse grid wire 20 and the grid wire 20 is seated in the dimples 34, as illustrated in FIG. 3. When thus installed, the link comprising the S-shaped curved portion 36 extends above the transverse grid wire 20, and also lies on top of the straddled pair of longitudinal grid wires 22. The staples 40 are subsequently applied, and then, in a conventional fashion, appropriate padding and a covering are applied to complete the foundation unit 10.

Various changes can be made to the invention without departing from the spirit thereof or scope of the following claims.

What is claimed is:

1. A wire support member for a foundation unit of the type having a grid wire top bearing structure and a rigid bottom substructure, the wire support member comprising a. a segment of serpentine wire comprising a continuous series of smoothly curved portions extending from one another and being bent into three segments, said segments comprising a pair of wire elements and a connecting means, b. said pair of wire elements arranged in mirror image to one another, said wire elements being located in spaced, parallel planes, and each wire element including i. a sinuous central segment comprising a series of generally C-shaped curved portions lying in one of said planes, adjacent curved portions being oppositely facing, ii. an upper attachment segment, and iii. a lower attachment segment, said sinuous central segment extending between said upper attachment segment and said lower attachment segment, c. said connecting means extending between and joining said upper attachment segments to form said wire support member as a continuous element, said connecting means comprising a transverse link which is an S-shaped smoothly curved portion connected to said upper attachment segments, and d. a grid wire engagement location formed in each upper attachment segment, said engagement location comprising a dimple in said upper attachment segment shaped to accommodate and seat a grid wire extending generally perpendicular to said upper attachment segment.

2. A wire support member according to claim 1 in which each sinuous central segment comprise three of said C-shaped curved portions in series.

3. A wire support member according to claim 1 in which said lower attachment segments are unattached to one another and each lower attachment segment includes a tip raised toward said central segment.

4. A foundation unit comprising a. a flat top bearing structure comprising spaced parallel longitudinal grid wires and spaced parallel transverse grid wires intersecting said longitudinal grid wires, said grid wires being affixed to one another where intersecting and at least said longitudinal grid wires including a grid wire pair having grid wires separated a predetermined interval, b. a rigid bottom substructure, c. a series of support members extending between said top bearing structure and said bottom substructure for maintaining a determined depth for the foundation unit, each support member being mounted on a said grid wire pair and each support member comprising i. a segment of serpentine wire comprising a continuous series of smoothly curved portions extending from one another and being bent into three segments, said segments comprising a pair of wire elements and a connecting means, ii. said pair of wire elements arranged in spaced, parallel planes, each wire element including a downwardly depending leg and an upper attachment segment and a lower attachment segment, said leg extending between said upper and lower attachment segments, iii. said connecting means extending between and joining said attachment segments to form said wire support member as a continuous element, said connecting means comprising a transverse link extending from one end of one attachment segment to an opposite end of the other attachment segment, said link being an S-shaped smoothly curved portion, said wire elements being separated at least by said predetermined interval, and iv. a grid wire engagement location formed in each upper attachment segment, said engagment location comprising a dimple in said upper attachment segment shaped to accommodate and seat one of said grid wires extending generally perpendicular to said upper attachment segment.

5. A foundation unit according to claim 4 in which each leg comprises a sinuous central segment formed of a series of generally C-shaped curved portions, adjacent curved portions being oppositely facing.

6. A foundation unit according to claim 5 in which each sinuous central segment comprises three of said C-shaped curved portions in series.

7. A foundation unit according to claim 5 in which said lower attachment segments are unattached to one another and each lower attachment segment includes a tip raised toward said upper attachment segment.

8. A foundation unit according to claim 4 in which each support member is mounted on said grid wire pair and on at least one of said transverse grid wires.

9. A method of installing a wire support member in a foundation unit, wherein the foundation unit includes a generally flat grid wire top bearing structure comprising spaced parallel longitudinal grid wires and at least one transverse grid wire intersecting said longitudinal grid wires, said longitudinal grid wires including at least one grid wire pair separated a predetermined interval, and wherein the wire support member comprises a pair of wire elements each having an upper attachment segment, said upper attachment segments being parallel and each having a depending leg, said attachment segments being separated at least by said predetermined interval, and including a transverse link extending from one end of one attachment segment to an opposite end of the other attachment segment to join the upper attachment segments to form the wire support member as a continuous element with the link and attachment segments lying generally in a top plane, the method comprising the steps of a. inserting the wire support member at an oblique angle to the top bearing structure with said legs straddling said grid wire pair and with one leg being located on one side of said transverse grid wire and the other leg being located on the other side of said transverse grid wire, and with said top bearing structure lying in a first plane which is at an oblique angle to said top plane, b. further inserting the wire support member and pivoting the support member until said first plane is generally coextensive with said top plane and said flat grid wire top bearing structure, and c. rotating said wire support member until said attachment segments are located beneath said transverse grid wire and said link is located above said transverse grid wire.

10. A method according to claim 9, in which each upper attachment segment includes a dimple shaped to accommodate and seat said transverse grid wire, and in which method step c includes rotating said wire support member until said transverse grid wire is seated in said dimples.

11. A method according to claim 9, including the step of affixing said legs to a rigid bottom substructure.

* * * * *